US005522329A

United States Patent [19]

Nakata

[11] Patent Number: 5,522,329

[45] Date of Patent: Jun. 4, 1996

[54] DEVICE FOR SELECTIVELY FEEDING BANDS IN A SEWING MACHINE

[75] Inventor: Norio Nakata, Takarazuka, Japan

[73] Assignee: Yamato Sewing Machine Mfg. Co, Ltd., Hyogo, Japan

[21] Appl. No.: 376,356

[22] Filed: Jan. 23, 1995

[30] Foreign Application Priority Data

Jan. 21, 1994 [JP] Japan ..... 6-022002

[51] Int. Cl.[6] ..... D05B 27/14; D05B 35/06

[52] U.S. Cl. ..... 112/152; 112/322

[58] Field of Search ..... 112/113, 152, 112/139, 322, 475.16, 417, 137

[56] References Cited

U.S. PATENT DOCUMENTS

| | | | |
|---|---|---|---|
| 2,681,019 | 6/1954 | Liebowitz | 112/152 X |
| 3,221,682 | 12/1965 | Burnell | 112/273 X |
| 4,829,919 | 5/1989 | Fieschi | 12/152 |
| 4,892,047 | 1/1990 | Fieschi | 112/152 X |

FOREIGN PATENT DOCUMENTS

| | | | |
|---|---|---|---|
| 2213792 | 9/1987 | Japan | 112/152 |
| 2206360 | 1/1989 | Japan | 112/152 |
| 2255787 | 11/1992 | United Kingdom | 112/152 |

*Primary Examiner*—Ismael Izaguirre
*Attorney, Agent, or Firm*—George J. Brandt, Jr.; Thomas R. Morrison; Morrison Law Firm

[57] ABSTRACT

A band feeding device feeds a selected one of a plurality of band-type materials (e.g. cloth tape, rubber) to a sewing machine for sewing to a ring-shaped garment such as, for example, the waist or crotch of a pair of trousers or briefs. One of a plurality of secondary rollers is moved to pinch its respective band between itself and a main roller. All other secondary rollers are moved away from the main roller, so that only the selected band is fed. This permits changing the type of band material being fed to the sewing machine without requiring the operator to remove and reinstall band materials each time. The number of elements in the overall device remains small, thus providing an inexpensive and compact device.

1 Claim, 3 Drawing Sheets

FIG. 2
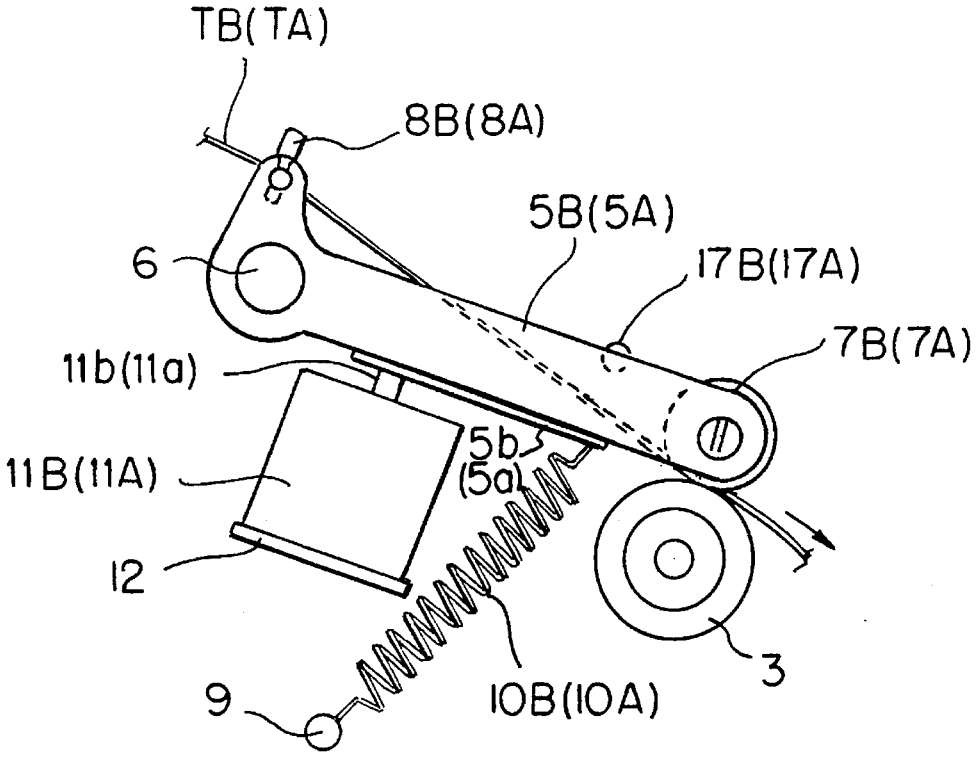
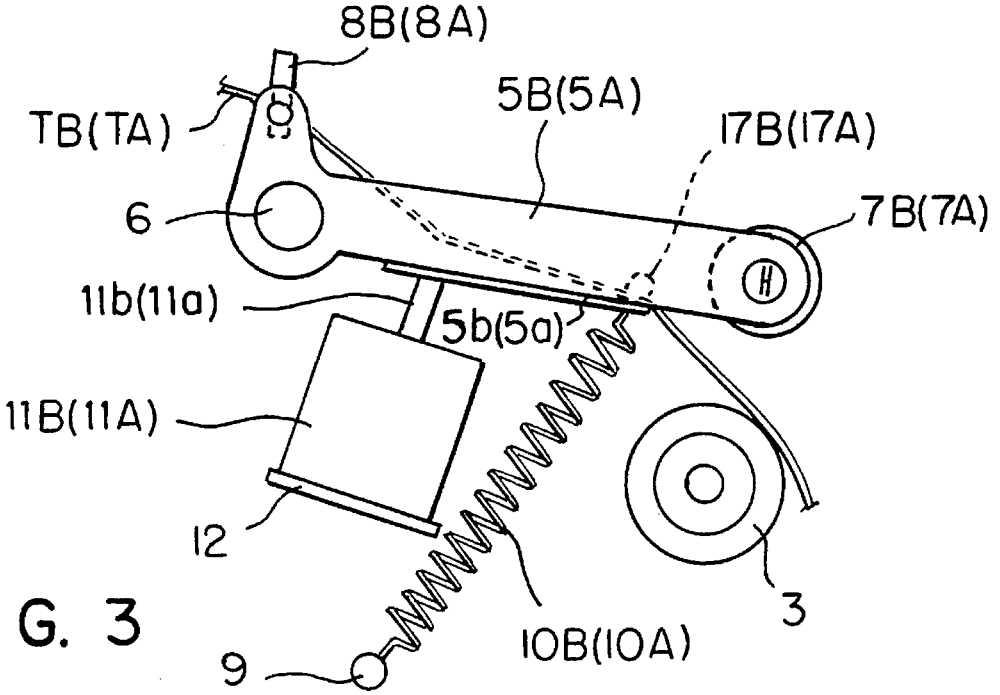
FIG. 3

DEVICE FOR SELECTIVELY FEEDING BANDS IN A SEWING MACHINE

BACKGROUND OF THE INVENTION

The present invention relates to a device for feeding band-shaped material in sewing machines. The sewing machines may be of a type suitable for sewing band-shaped material (e.g. tape, rubber) to a circular material (e.g. the waist or the crotch of a pair of briefs). More specifically, the present invention is a device for feeding bands in sewing machines selecting one out of a plurality of band-shaped material having different widths, colors, and the like that are disposed around the sewing machine head (e.g. above the head). This selected band of material is interposed between a main and a secondary roller and fed to the sewing section of the sewing machine.

In the prior art, this kind of band feeding device for sewing machines used a single band feeding device comprising a main and a secondary roller arranged near the sewing machine head (e.g. above the head). A band of material out of a plurality of types of bands is selected and set in place to be sewn. This single band is interposed between the main and secondary rollers which feed it to the sewing section.

In this arrangement, where only a single band feeding device is used, it is necessary to reset the band material and reinsert the material between the pair of rollers each time a different band out of a plurality of types of bands is to be sewn to a material. This is complicated for the operator, requires an excessive amount of time, and leads to a decrease in sewing efficiency. In particular, when bands of material are sewn to a single material at different positions (e.g. the waist and crotch), the above procedures must be carried out repeatedly. This interrupts operations frequently and results in significant decreases in efficiency.

In another embodiment of the prior art, a plurality of band feeding devices, each including a main roller and a secondary roller are arranged side by side either laterally or longitudinally near the head of the sewing machine (e.g. above the head). Different types of band materials are set in each of the plurality of band feeding devices, and one of the band feeding devices is selected to perform a feeding operation to the sewing section of the sewing machine. The arrangement of the plurality of band feeding devices laterally or longitudinally increases the bulk of the overall device, and increases the cost.

OBJECTS AND SUMMARY OF THE INVENTION

The object of the present invention is to overcome the drawbacks described above of the prior art.

A further object of the present invention is to provide automatic selection and feeding of a plurality of types of bands without requiring manual procedures such as removing bands from the rollers and resetting the bands. This object is to be achieved while minimizing the number of elements in the device as much as possible and providing a low-cost device.

Another object of the present invention is to decrease the amount of space occupied by the band feeding device and to offer a more compact device.

Yet another object is to provide a substantially fixed tension for the band without applying excessive pull so that the band can be fed to the material and sewn.

Yet another object is to prevent bands that are not supposed to be fed from being fed.

According to an embodiment of the invention, there is provided a band feeding device that feeds a selected one of a plurality of band-type materials (e.g. cloth tape, rubber) to a sewing machine for sewing to a ring-shaped garment such as, for example, the waist or crotch of a pair of trousers or briefs. One of a plurality of secondary rollers is moved to pinch its respective band between itself and a main roller. All other secondary rollers are moved away from the main roller, so that only the selected band is fed. This permits changing the type of band material being fed to the sewing machine without requiring the operator to remove and reinstall band materials each time. The number of elements in the overall device remains small, thus providing an inexpensive and compact device.

According to an embodiment of the invention, there is provided a band feeding device for sewing machines comprising: a main roller, means for rotating the main roller, means for feeding at least first and second bands adjacent a surface of the main roller, at least first and second secondary rollers aligned with the first and second bands, means for urging the first secondary roller toward the main roller such that the first band is pinched therebetween for feeding the first band to the sewing machine, means for urging the second secondary roller toward the main roller such that the second band is pinched therebetween for feeding the second band to the sewing machine, and means for selecting one of the first the second secondary roller for urging toward the main roller, and for moving all other rollers away from the main roller, whereby a selected one of the at least first and second bands is fed to the sewing machine, while all other bands remain inactive.

According to a feature of the invention, there is provided a band feeding device for sewing machines comprising: a main roller, first and second secondary rollers, means for maintaining the first and second secondary rollers a fixed distance apart on opposed sides of the main roller, means for moving the first and second secondary rollers in a generally radial direction of the main roller between first and second positions, means for feeding a first band-type material between the main roller and the first secondary roller, means for feeding a second band-type material between the main roller and the second secondary roller, the first position bringing the first secondary roller into contact with a first side of the main roller, thereby feeding the first band-type material and moving the second secondary roller out of contact with the main roller, thereby preventing feeding of the second band-type material, the second position bringing the second secondary roller into contact with an opposed side of the main roller, thereby feeding the second band-type material, and moving the first secondary roller out of contact with the main roller, thereby preventing feeding of the first band-type material, and means for rotating the main roller in a first direction while the secondary rollers are in the first position, and for reversing rotation of the main roller when the secondary rollers are in the second position, whereby unidirectional feed of the first and second band-type material is provided.

In order to achieve the objects described above, the device for feeding bands to a sewing machine according to the first embodiment of the present invention comprises: a single rotating main roller in contact with a plurality of types of bands to be fed to a sewing section of a sewing machine; a plurality of secondary rollers capable of coming into contact and moving away from the outer surface of fig main roller, and, while in contact with the main roller, capable of supporting a band material and feeding it to the sewing section of the sewing machine; and a secondary roller selection mechanism selecting one out of a plurality of secondary rollers and putting it into contact with the outer surface of the main roller, while moving the other secondary rollers away from the outer surface of the main roller.

With the first embodiment of the present invention configured as described above, one of the plurality of secondary rollers is selected by the secondary roller selection mechanism and pressed against the outer surface of the main roller. The other secondary rollers are moved away from the outer surface of the main roller. This allows one out of a plurality of bands to be automatically selected and interposed between the main and secondary rollers so that it can be fed to the sewing section. Thus, when one out of a plurality of bands is to be sewn onto a material, the need for resetting bands and reinstalling bands between main and secondary rollers is eliminated. This avoids the necessity for excessive manual operations, and allows an overall improvement in the efficiency and ease of operation in sewing. The embodiment also allows a single drive device and main roller to be used no matter which band of material is being fed. This requires fewer elements compared to a configuration involving a plurality of band feeding devices arranged laterally or longitudinally with each having a pair of rollers. Thus, the production costs of the overall device can be lowered.

The second embodiment of the invention is configured as described in the first embodiment of the invention wherein the plurality of secondary rollers is arranged in a row above the main roller along the direction of the axis of the main roller.

With the second embodiment of the invention as described above, the space occupied by the band feeding device is minimized and the overall device can be made more compact.

The third embodiment of the invention is configured as described in the first embodiment further comprising: springs that press against each of the secondary rollers so that they press against the outer surface of the main roller; and cylinders that act against the elastic energy of these springs and move each of the secondary rollers away from the outer surface of the main roller.

According to the third embodiment of the invention as described above, the secondary roller selection mechanism uses the elastic energy of the springs to adapt the holding strength of the main and secondary rollers to different thicknesses in the band material. This provides smooth and reliable feeding of the material.

The fourth embodiment of the invention is configured as described above and further comprises: a sensor for detecting the amount of band material being fed, arranged at a position closer to the band material feed than the main roller; and a control device driving the band material switching to a band material feeding state when the value detected by the sensor is at or below a certain value.

According to the fourth embodiment of the invention as described above, the amount of band material fed is detected by the sensor. When the detected value is equal to, or less than, a certain value, the main roller is driven to feed the band material and the device is switched to a feed state. This prevents excess pull from being applied to the band material, and allows the band material to be fed to the sewing material with a fixed tension.

The fifth embodiment of the invention is configured as described above and further comprises a band material supporting body which acts in response to the secondary roller moving toward and away from the outer surface of the main roller. When the secondary roller is pressed against the main roller, the pressure on the band material is released. When the secondary roller is situated away from the band material, pressure is maintained on the band material.

According to the fifth embodiment of the invention as described above, one of the secondary rollers is pressed against the outer surface of the main roller, while the other secondary rollers are separated from the main roller. The band material for the secondary rollers that are separated from the main roller, i.e. the non-feeding band material, can be held by pressure. This prevents problems involving failure to detect the non-feeding band material by the sensor and therefore cause an unnecessary amount of non-feeding band material to be fed out.

The above, and other objects, features and advantages of the invention will become apparent from the following present description read in conjunction with the accompanying drawings, in which like reference numerals designate the same elements.

BRIEF DESCRIPTION OF THE DRAWINGS

FIG. 2 is an enlarged side view of the main elements of the band feeding device of FIG. 1 to which reference will be made describing the operations of this embodiment.

FIG. 3 is an enlarged side view of the main elements for the purpose of describing the operations of the above embodiment.

DETAILED DESCRIPTION OF THE PREFERRED EMBODIMENTS

The following is a description of an embodiment of the present invention. The description refers to a case where tape is used as the band material, but of course it is possible to apply the invention to a band material other than tape such as rubber. Also, in this embodiment, the device is arranged behind and above the head of the sewing machine, but the positioning is not limited to this arrangement, and can, for example, involve placing the device to the side of or below the head of the sewing machine.

Figure 1:
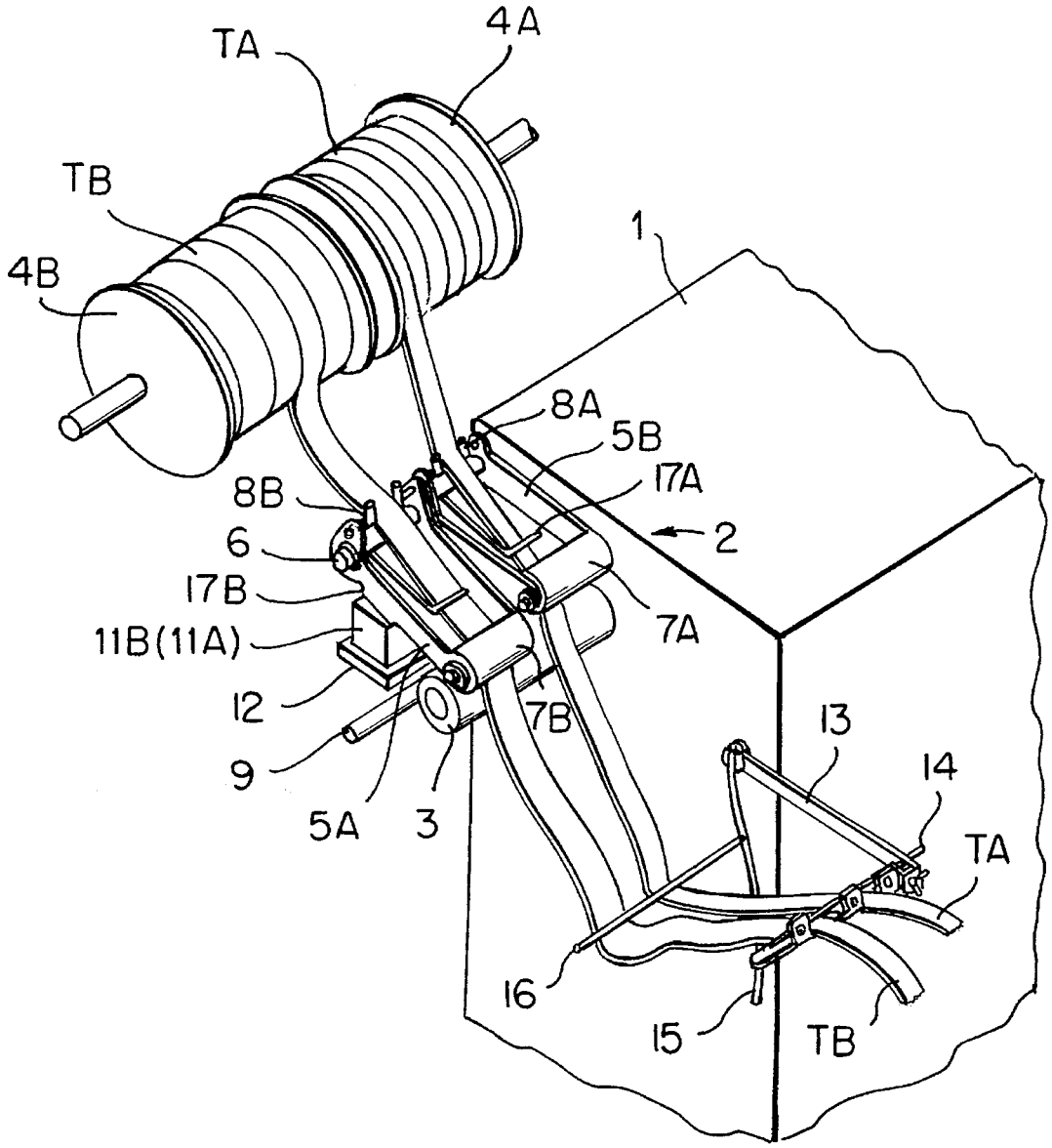
FIG. 1 is a schematic perspective drawing of a band feeding device for sewing machines according to an embodiment of the present invention.

Referring to FIG. 1, a control box, shown generally at 1, is disposed to the top and to the rear of a sewing machine frame. A band material feeding device 2 is arranged on the side of control box 1. Band material feeding device 2 includes a main roller 3 having an axial length long enough to cover two types of tapes TA, TB. Tapes TA, TB, which may have different widths, are fed from reels 4A, 4B located behind and above main roller 3. Main roller 3 is rotated by a motor (not shown in the drawing) installed in control box 1. Secondary roller supports 5A, 5B are free to pivot freely around a shaft 6 parallel to main roller 3.

Referring to FIG. 2 and FIG. 3, secondary rollers 7A, 7B are rotatably supported at the ends of the secondary roller supports 5A, 5B, respectively, so that they can press against and move away from the outer surface of main roller 3 resulting from up/down motion of secondary roller supports 5A, 5B. Secondary rollers 7A, 7B are arranged in a row in the axial direction above main roller 3. When a secondary roller is pressed against main roller 3, tape TA or TB is supported from above and below while being ted to the sewing section of the sewing machine.

Tape guides. 8A, 8B are pairs of projections separated by an distance corresponding to the width of tapes TA, TB. Tape guides 8*a*, 8*b* are arranged on the base end of secondary roller supports 5A, 5B above shaft 6.

A shaft 9, parallel to main roller 3, is fixed to a side of control box 1 below and toward the end of secondary roller supports 5A. A pair of springs 10A, 10B are stretched between shaft 9 and a position toward the ends of secondary roller supports 5A, 5B. The elastic force of springs 10A, 10B urges secondary roller supports 5A, 5B around and below shall. 6 and presses secondary rollers 7A, 7B against the outer surface of main roller 3.

Cylinders 11A, 11B are arranged next to each other on cylinder attachment base 12, which is fixed on a side of control box 1. Cylinders 11A, 11B include shafts 11*a* and 11*b*, respectively, which are in contact with the approximate center of the lower surfaces of secondary roller supports 5A, 5B. When cylinder shafts 11*a*, 11*b* are extended, secondary roller supports 5A, 5B are moved around shaft 6 against the elastic force of springs 10A, 10B. This results in secondary rollers 7A, 7B being moved away from the outer surface of main roller 3. Cylinder shafts 11*a*, 11*b* extend outward or inward in response to a control device (not shown in the drawings) within control box 1. Thus, a secondary roller selection mechanism moves secondary rollers 7A, 7B toward or away from main roller 3 by the opposition of springs 10A, 10B and cylinder shafts 11*a*, 11*b* in response to a control device. The rollers are controlled so that when one moves toward the main roller 3, the other moves away from main roller 3.

A tape guide 14, in contact with two tapes TA, TB, is attached to an end of a tape guide base 13. A vertically curved sensor guide groove 15 is formed on the side of control box 1. A sensor 16, in the form of a shaft extending across the feed paths of the tapes of the plurality, is inserted in sensor guide groove 15. Sensor 16 is in contact with tapes TA, TB such that it is moved up and down by increases and decreases in the amount of feed of the tapes. When the feed amount of the tapes detected by sensor 16 is at or below a specific value, i.e. when sensor guide 16 moves up from sensor guide groove by a prescribed amount or greater due to a decrease in the feed of tape TA or TB and an increase in tape tension, the motor in control box 1 increases the speed at which main roller 3 is driven until the amount of tape permits sensor 16 to return to a normal position.

When a change in tape is required, the active secondary roller 7A or 7B moves away from main roller 3, and the previously inactive secondary roller 7A or 7B moves into an active position pinching its respective tape TA or TB against main roller 3. In this way, automatic switching of tape feed is accomplished.

Tape holders 17A, 17B are attached to secondary roller supports 5A, 5B to serve as tape supports. Base ends of tape holders 17A, 17B are attached to shaft 6.

Referring to FIG. 2, when secondary rollers 7A, 7B are positioned down and are feeding the tape in contact with the outer surface of main roller 3, tape holders 17A, 17B move away from the top surface of tape TA, TB to release the pressure on tapes TA, TB between tape holders 17A, 17B and bottom plates 5*a*, 5*b* of secondary rollers 5A, 5B.

Referring to FIG. 3, when secondary rollers 5A, 5B are in the up position, and are in a non-feeding state for tapes TA, TB, which are separated from the outer surface of main roller 3, tape holders 17A, 17B are in contact with the upper surface of tapes TA, TB to maintain pressure on tapes TA, TB between tape holders 17A, 17B and bottom plates 5*a*, 5*b* of secondary rollers 5A, 5B.

A side cover is attached to the side of band feeding device 2 so that tapes TA, TB do not slide off their feeding paths, but this is not shown in the drawings.

Referring again to FIG. 2, when cylinder 11B is in its retracted condition, the elastic force of spring 10B moves secondary roller support 5B downward around shaft 6. This urges secondary roller 7B, at the end of roller support 5B into contact with the outer surface of main roller 3. Tape holder 17B moves away from the upper surface of tape TB and releases pressure from tape TB between tape holder 17B and bottom plate 5*b* of secondary roller support 5B.

Returning to FIG. 3, meanwhile, the other cylinder, cylinder 11A is extended. Secondary roller support 5A is moved upward around shaft 6, against the elastic force of spring 10A. Secondary roller 7A, on the end of secondary roller support 5A, is moved to a position away from the outer surface of main roller 3. Tape holder 17A maintained in contact with the upper surface of tape TA, thus maintaining pressure on tape TA between tape holder 17A and bottom plate 5*a* of secondary roller support 5A.

In this condition, wide tape TB from reel 4B passes through tape guide 8B and is interposed between main roller 3 and secondary roller 7B. With the rotation of main roller 3, tape TB contacts sensor 16, passes through tape guide 14 and is fed toward the sewing section of the sewing machine at a predetermined speed.

While this is being done, a generally constant tension is maintained on tape TB based on the detection by sensor 16 of the amount of tape TB being fed. This detected feed amount is used to control the rotation of main roller 3. Thus, excess tension on tape TB is avoided so that sewing can be done with approximately constant tension.

Similarly, for feeding narrow tape TA, pressure is maintained between tape holder 17A and bottom plate 5*a* of secondary roller support 5A. The amount of tape TB being fed is detected by sensor 16 to control the rotation of main roller 3. This rotation control prevents unnecessary feeding of tape TB.

With the embodiment described above, two secondary rollers 7A, 7B were arranged side by side above a single main roller 3 along its axis direction.

Figure 4:
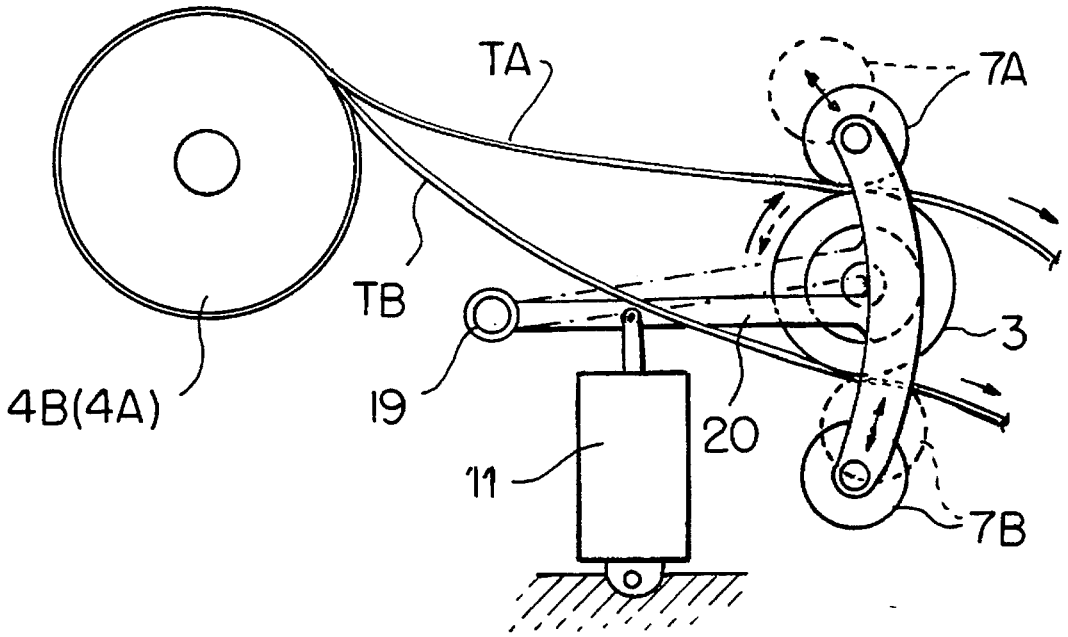
FIG. 4 is a schematic side view showing the main elements of another embodiment of the invention in which a tape TA is being fed.

Referring now to FIG. 4, secondary rollers 7A, 7B are disposed on opposing sides in the radial direction of a single main roller 3. A moving arm 20 is urged upward and downward by a single cylinder 11. Secondary rollers 7A, 7B are maintained a fixed distance apart so that, when one is brought into contact with main roller 3, the other is moved out of contact. In addition to controlling the position of cylinder 11, the control device also reverses the direction of rotation of main roller 3 in order to provide unidirectional drive, regardless of which of secondary rollers 7A and 7B are brought into action.

Also, in the above embodiment, secondary rollers 7A, 7B move away from and toward main roller 3. However, it within the scope of the invention to provide three or more secondary rollers side by side and have one selected to come into contact with the outer surface of main roller 3, while all the other secondary rollers move away from main roller 3. In this case, it may be desirable the control device to respond to manual activation of a selection button. The selection button is pressed by the machine operator to select which of the secondary rollers should come into contact with main roller 3.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A feeding device for selectively feeding individual ones of bands selected from a plurality of such bands to a sewing machine, said feeding device comprising a rotary main roller, a corresponding plurality of secondary rollers, the secondary rollers each being movable between a first position wherein each such secondary roller pinches an associated one of said bands against the main roller thereby to effect feed of the said one band to the sewing machine to a second position wherein the secondary rollers are remote from the main roller, a secondary roller selection and moving mechanism operable to position a selected one of said secondary rollers of said plurality of secondary rollers in a first position thereof and any other secondary roller in said plurality of secondary rollers in second position thereof, said secondary roller selection and moving mechanism comprising a corresponding plurality of springs each engaged with a corresponding secondary roller and operable to bias said corresponding secondary roller into its first position, and a corresponding plurality of cylinder units each engaged with a corresponding secondary roller and operable to move said corresponding secondary roller to its second position in opposition to the bias of the corresponding spring, a corresponding plurality of band supports, each band support being operable to release any pressure on a band associated therewith when the secondary roller associated with the said band is in first position, each said band support being operable to support an associated band when the secondary roller associated with the said band is in second position, a sensor shaft located downstream of said main roller and extending across feed paths of all of the respective ones of the plurality of bands, said sensor shaft having a normal sensor position wherein the bands are disposed at an underside of the said sensor shaft, said sensor shaft being movable upwardly from its normal sensor position responsive to a decrease in the amount of a selected band material feed, said sensor shaft being effective when it has been moved upwardly from its normal sensor position by a prescribed amount to control main roller rotation to increase the selected band material feed amount such that the sensor shaft can return to its normal position.

* * * * *